United States Patent [19]

Saito et al.

[11] 4,323,048

[45] Apr. 6, 1982

[54] BALL SHOOTING MACHINE FOR VOLLEYBALL PRACTICE

[75] Inventors: Retsuo Saito; Junji Nagase, both of Odawara, Japan

[73] Assignee: Kabushiki Kaisha Tokiwa Seisakusho, Japan

[21] Appl. No.: 181,624

[22] Filed: Aug. 26, 1980

[30] Foreign Application Priority Data

Jul. 17, 1980 [JP] Japan ..... 55-101167[U]

[51] Int. Cl.[3] ..... F41B 3/04

[52] U.S. Cl. ..... 124/78; 124/80

[58] Field of Search ..... 124/78, 49, 81, 29, 124/1; 273/26 D

[56] References Cited

U.S. PATENT DOCUMENTS

| | | | |
|---|---|---|---|
| Re. 28,462 | 7/1975 | Halstead | 124/78 |
| 3,794,011 | 2/1974 | Newgarden | 124/78 |
| 4,197,827 | 4/1980 | Smith | 124/78 |

*Primary Examiner*—Richard C. Pinkham
*Assistant Examiner*—William R. Browne

[57] ABSTRACT

A ball shooting machine for volleyball practice has a pair of tire-wheel type ball shooting mechanisms supported by members comprising an intermediate rod, a pillar and legs. Mechanisms for varying the shooting angle, direction, height and course of the ball are provided at each joint of the supporting members respectively. Balls are charged in a member mounted at such a specific angle as to make it possible to charge the ball smoothly irrespective of the inclination or position of the ball shooting machine.

1 Claim, 6 Drawing Figures

BALL SHOOTING MACHINE FOR VOLLEYBALL PRACTICE

BACKGROUND OF THE INVENTION

The present invention relates to a ball shooting machine for volleyball practice. More particularly, the invention is concerned with a ball shooting machine which can shoot a ball continuously toward a trainee to realize various types of shooting such as service, toss, spike and so forth at various aims, directions, angles and heights.

In the case of a baseball game, the position of the pitcher and the direction of the ball thrown by him are substantially unchanged, so that a simple pitching machine satisfying these requisites can well simulate the condition of a ball thrown by the pitcher.

However, in a volleyball game, the position, direction, angle and height of the ball are changed much more widely than in the case of baseball.

As to the service, for example, the server is allowed to make the service from any position and height in the service area outside the end line of the court. In addition, the ball flies in various manners. In some cases, the ball flies fast and linearly, while at the other times the ball flies slowly along a vertically curved line. Also, there are many types of service such as floater service in which the ball itself does not rotate at all, drive service in which the ball is strongly rotated and so forth. The course of the ball is changed in accordance with the direction of rotation of the ball.

The receiver has to receive and hit the service ball the nature of which widely varies as stated above.

The receiver is often required to hit the ball obliquely and upwardly to a moderate level so that his fellow may shoot the ball easily toward the opposite court. Such a type of receive is called a "toss". The tossed ball is hit from the maximum height at a position near the net into the opposite zone beyond the net. This hitting is referred to as a "spike".

SUMMARY OF THE INVENTION

The present invention seeks to provide a ball shooting machine for volleyball practice, which can be promptly and reliably operated for realizing various natures of the flying ball such as service, toss and spike without failure, even by an ordinary person who likes sports but has no specific knowledge concerning the machine, and which has a simple construction and can be produced and sold at a low price to enable an ordinary sport club to purchase the machine.

Briefly, according to the invention, there is provided a ball shooting machine comprising a pair of tire-wheel type ball shooting mechanisms, supporting means including an intermediate rod, a pillar and legs, means provided at each joint of the members of the supporting means for varying the shooting angle, shooting direction, shooting height and course, and a ball charging means mounted at such a specific angle as to make it possible to charge the ball smoothly irrespective of the inclination or position of the ball shooting mechanism.

The construction and operation of the ball shooting machine in accordance with the invention will be described hereinunder with reference to the drawings.

DESCRIPTION OF THE PREFERRED EMBODIMENTS

The construction of the mechanism for shooting the ball is substantially the same as that of the volleyball or tennis ball serving machine as proposed in the specifications of U.S. Pat. Nos. 3,774,584 and 3,724,437. Namely, this mechanism has a pair of motors 8 and 9 attached to one side of a rectangular supporting plate 7. These motors 8 and 9 are adjustable for varying the operation speeds independently of each other. Attached to the other side of the supporting plate 7 are a pair of tire wheels 10 and 11 spaced by a gap slightly smaller than the diameter of the ball. In order to avoid any danger during rotation, these tire wheels are concealed by covers 10*a* and 11*a* such that only the aforementioned gap is exposed. Both covers 10*a*, 11*a* are fixed to the supporting plate 7.

Figure 2:
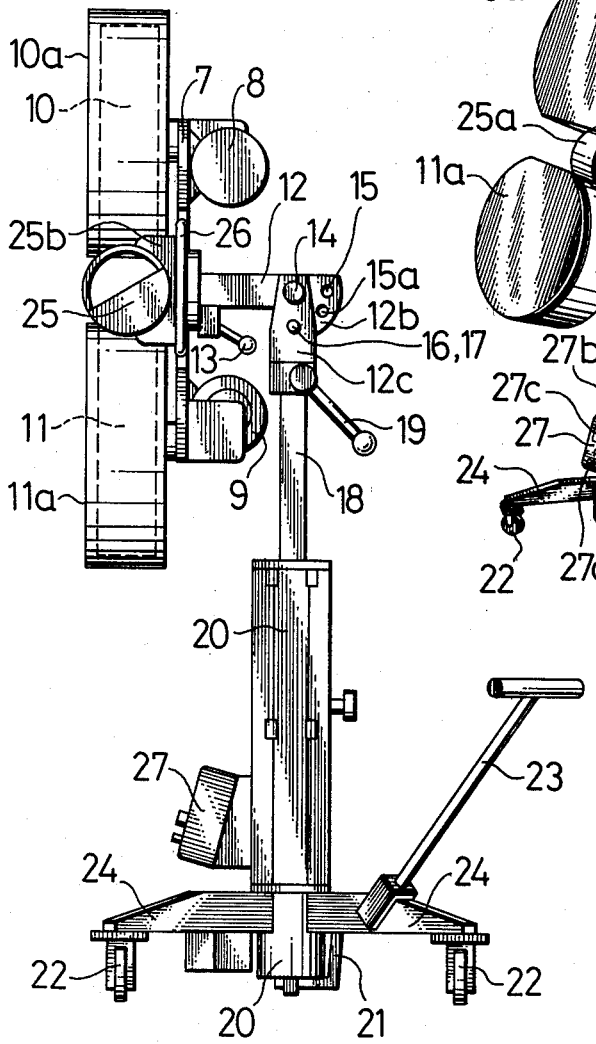
FIG. 2 is a rear elevational view of the ball shooting machine shown in FIG. 1.
Figure 1:
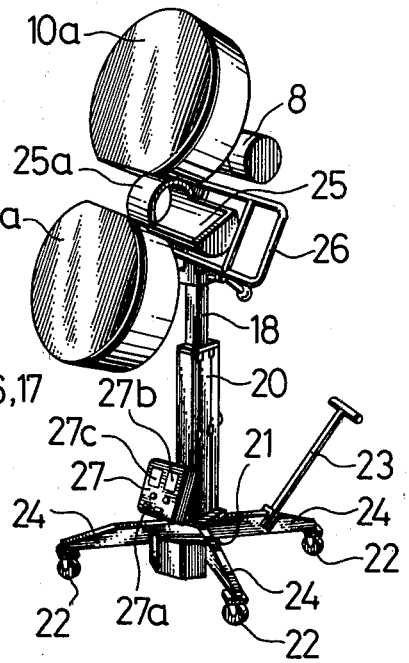
FIG. 1 is a perspective view of a ball shooting machine constructed in accordance with an embodiment of the invention as viewed obliquely downwardly from an upper left point.

In the embodiment shown in FIGS. 1 and 2, the tire wheels 10 and 11 have a considerably large diameter, and the transmission of the power from the motors 8 and 9 are made through bevel gears which are not shown.

Figure 5:
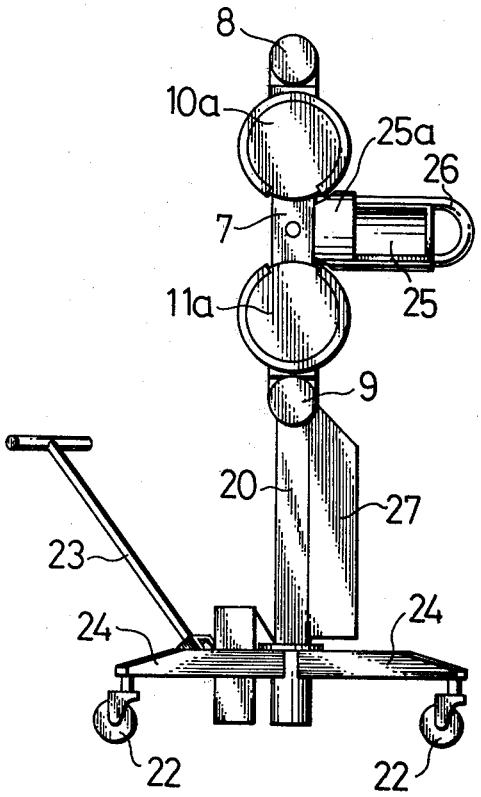
FIG. 5 is a right side elevational view of a second embodiment of the invention.
Figure 6:
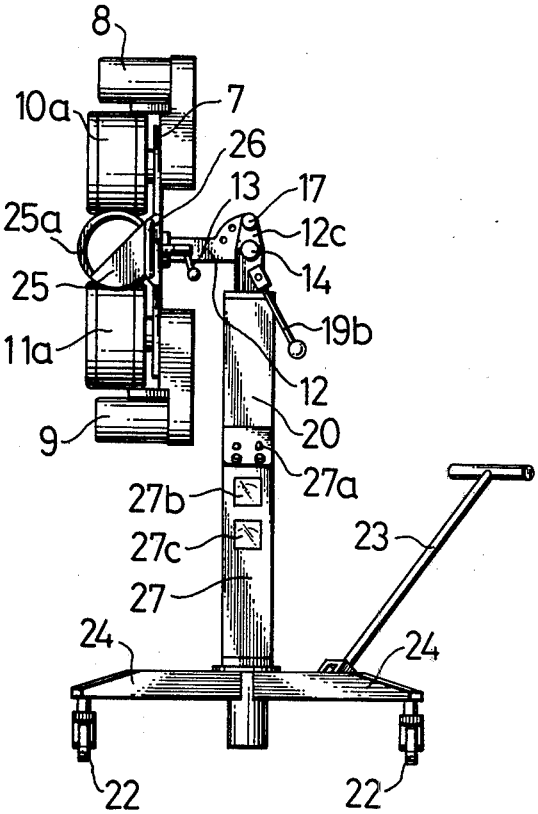
FIG. 6 is a rear elevational view of the second embodiment.

In the embodiment shown in FIGS. 5 and 6, the tire wheels have a small diameter so that the power is transmitted from the motors 8 and 9 through belts which are not shown. Since the motors are positioned at the outer sides of the associated tire wheels, the construction of the machine as a whole is made compact and small and the handling is very much facilitated.

The aforementioned ball shooting mechanism is supported by a specific supporting means designed and constructed to produce various natures of flying ball peculiar to the volleyball.

Namely, the supporting means include an intermediate rod 12 for supporting the central part of the supporting plate 7, a pillar 18 for supporting the intermediate rod and legs 24 projecting in four directions and adapted to support the pillar in an upright position. A ball angle changing means is provided at the joint between the supporting plate 7 and the intermediate rod 12. A ball course changing means adapted to change the course of the curve of the ball in cooperation with the difference in speed between the two tire wheels is provided at an intermediate portion of the intermediate rod 12. A ball direction changing means is provided at the joint between the intermediate rod 12 and the pillar 18. A shooting height changing means is provided at the joint between the pillar 18 and the legs 24. Finally, a shooting position changing means is incorporated in the legs 24. Various natures of flying ball necessary in the volleyball game can be produced by the operation of the above mentioned means solely or in combination.

A bore 12*d* is formed in one end surface of the intermediate rod 12 so as to receive a hub 12*a* which in turn is connected to the rod 12 by means of a cotter 12*e*. The end of the hub 12*a* is rotatably supported by a hole 7*a* formed at a mid portion of the supporting plate 7. A segment 7*b* coaxial with the hub 12*a* is fixed to one side surface of the supporting plate 7. The segment 7*b* is toothed at its periphery as at 7*c*.

On the other hand, a bracket 13*a* is fixed to one end of the intermediate rod 12, and a claw 13*c* rockable around a pin 13*b* is attached to the end of the bracket 13*a*. Female threaded bores are formed in the tail end portion of the claw 13*c* and the base portion of the bracket. These threaded bores have threads of opposite screwing directions. A male screw rod 13*d* having two sections of different screw directions is screwed into these bores. A manipulation rod 13 projects outward from an intermediate portion of the screw rod.

Figure 3:
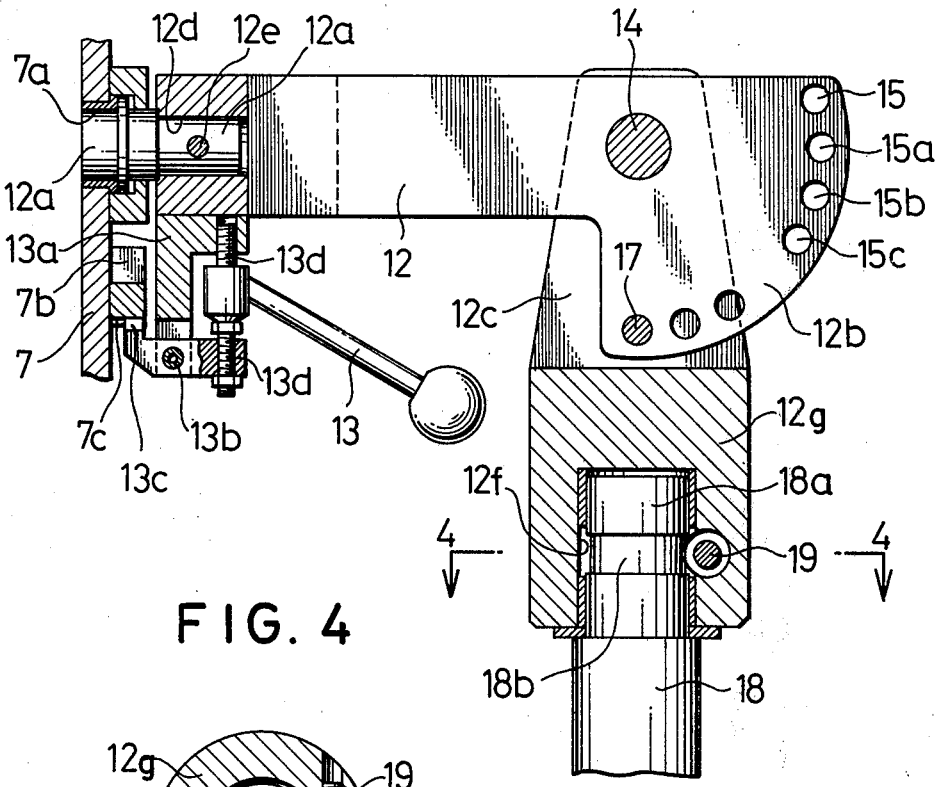
FIG. 3 is an enlarged sectional view of a connection portion shown at the central portion of FIG. 2.
Figure 4:
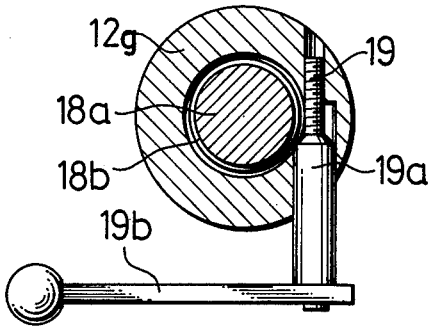
FIG. 4 is a cross-sectional horizontal view taken along the line 4–4 of FIG. 3.

The arrangement is such that as the manipulation rod 13 is pulled from the position shown in FIG. 3 toward the operator, the claw 13*c* engages the teeth 7*c* of the segment, whereas, when the manipulation rod is pushed back away from the operator, the claw 13*c* is disengaged from the teeth 7*c* so as to permit the supporting plate 7 to rotate around the intermediate rod 12, thereby to make the ball shooting angle adjustable.

As shown in FIG. 3, a flat segment 12*b* is formed at an the other end of the intermediate rod 12. The segment 12*b* is rotatably carried by the bracket 12*c* by means of a support shaft 14. Further, a plurality of pin-receiving holes 15, 15*a*, 15*b*, 15*c* are formed along an arc centering the support shaft of substantially 90° in the peripheral portion of the segment 12*b*. A pin receiving bore 16 (See FIG. 2) is formed at a portion of the bracket 12*c* which can align the pin-receiving holes. The pin-receiving bore 16 receives a lock pin 17. The arrangement is such that the intermediate rod 12 is locked at an upright position as the pin-receiving hole 15*a* is aligned by the lock pin 17 and locked by the latter. Similarly, the intermediate rod 12 can be fixed at a horizontal posture if the locking is made in the state shown in FIG. 3. It will be seen that the rod 12 can be fixed at any desired angle as it is locked at a position between the upright and horizontal positions. It is possible to change the course or direction of the curve in various ways by suitably changing the angle of inclination of the segment 12*b* in combination with the speed change in the pair of motors 8 and 9.

Formed in the end surface of the base member 12*g* of the bracket 12*c* is a hole 12*f* which rotatably receives a supporting boss 18*a* projecting upwardly from the end surface of the pillar 18. An annular groove 18*b* is formed in an intermediate portion of the supporting boss 18*a* so as to extend in the circumferential direction of the latter. A screw rod 19 screwed into a female threaded bore in the base member 12*g* is movable in the direction tangent to the annular groove 18*b*. The base member 12*g* is locked against rotation relative to the supporting boss 18*a* as the slide key 19*a* integral with the screw rod 19 is driven into the annular groove 18*b* by a rotation of a manipulation lever 19*b*. The base member 12*g* is allowed to rotate as the slide key 19*a* is retracted from the annular recess 18*b*. The ball shooting direction can be varied as desired by the rotary operation on the top of the supporting pillar 18.

The lower end of the pillar 18 is received by a hydraulic cylinder 20 so as to act as a plunger when a pressurized oil is supplied into the hydraulic cylinder. A reference numeral 21 denotes an operation pedal. The height of the shooting position can be freely changed by the vertical movement of the pillar 18.

Three or four radially extending legs 24 are attached to the lower end of the hydraulic cylinder 20. Each leg is provided at its lower end with a caster 22. One of the legs is provided with a transportation lever 23. The casters 22 and the transportation lever 23 in combination serve to easily change the ball shooting position.

The ball charging means comprises a semi-cylindrical portion 25 and a cylindrical portion 25*a* integral with the latter. The cylindrical portion 25 is mounted at a position so as to open into the gap between the tire wheels 10, 11 from the rear side thereof. The semi-cylindrical portion 25 is attached to the supporting plate 7 through a bracket 25*b* such that the outer surface thereof is inclined at an angle of 30° to 60° to the supporting plate 7. It is therefore possible to charge the semi-cylindrical portion 25 stably with the balls irrespective of whether the intermediate rod 12 takes a horizontal posture as illustrated or a vertical posture not shown, not to mention the intermediate inclined posture.

A reference numeral 26 denotes a manipulation handle which projects rearwardly from the supporting plate 7, while a reference numeral 27 denotes a control box on which are provided switches 27*a* and tachometers 27*b*, 27*c* for the motors.

For shooting a service ball, the machine is moved to the service area by means of the caster 22 and the transportation lever 23. The height of the shooting position may be high or low and the shooting angle can be freely selected to aim at any desired portion of the opposite zone. Also, the shooting angle can be changed between horizontal to obliquely upward angles.

If the pair of motors 8 and 9 are driven at an equal speed, the served ball will not rotate so that the floater service can be realized. If one of the motors is driven at a speed much higher than that of the other, the ball will be rotated to realize the state of the drive serve. Also, the course of the flying ball can be changed by altering the pin-receiving holes 15, 15*a*, 15*b* . . . with the lock pin 17 so as to change the position of the intermediate rod 12 between the illustrated horizontal posture and the vertical posture. As stated before, the supply of the balls to the semi-cylindrical ball charging means 25 is achieved stably irrespective of the posture of the rod 12.

For realizing the state of the toss ball, the machine is moved to the position near the center of the court or near the net. The shooting position is lowered while the shooting angle is adjusted to aim at a point obliquely upwardly spaced from the machine. Also, the shooting direction is selected to aim at a point substantially above the net.

For realizing the spike state, the machine is moved to a position near the net. The shooting is made from the highest shooting position at an obliquely downward shooting angle, aiming at any desired point in the opposite zone by suitable adjustment of the shooting direction.

As has been described, according to the invention, there is provided a ball shooting machine for volleyball practice, in which a known ball shooting mechanism incorporating a pair of tire wheels is supported by means of legs 24 through the mediums of the intermediate rod 12 and the pillar 18, and a plurality of means for adjusting the shooting angle, direction, height, position and course, which means are adjustable independently of each other, are installed at respective joints between the members of the supporting structure.

It is, therefore, possible to promptly and surely realize all natures of flying ball peculiar to a volleyball game, with a machine which can be purchased at a low price. Thus, the present invention greatly contributes to the training of individuals who like to play volleyball.

What is claimed is

1. A ball shooting machine for volleyball practice comprising: a volleyball shooting mechanism including a supporting plate, a pair of motors attached to said supporting plate, said motors being adjustable independently of each other for varying their operational speeds, and a pair of tire wheels rotatably attached to said supporting plate and opposing each other with a gap therebetween somewhat smaller than the diameter of the ball, said tire wheels being adapted to be rotatively driven by respective ones of said motors; supporting means including an intermediate rod in support of said supporting plate, a pillar supporting said intermediate rod and at least three radially extending legs for supporting said pillar in an upright position; ball shooting angle changing means including a rotatable couple between the center of said supporting plate and one end of said intermediate rod, and locking means provided in said couple to releasably lock said plate in a plurality of rotatable positions; ball course changing means including rotating means at the other end of the rod which is adapted for making said intermediate rod rotatable at an intermediate portion of the latter through substantially 90°, and locking means associated with said rotating means for changing the angle of inclination of said supporting plate between vertical and horizontal positions; ball shooting direction changing means including a rotatable couple connecting the other end of said intermediate rod and the upper end of said pillar and locking means associated with said couple for locking the rod against rotation; hydraulically operable shooting height changing means including a hydraulic cylinder between the lower end of said pillar and said legs and the lower end of said pillar received by said hydraulic cylinder; shooting position changing means including a transportation lever attached to one of said legs and casters attached to said legs; and ball charging means for feeding balls to the wheels, said ball charging means including a cylindrical portion opening to said gap between said two tire wheels from the rear side of the latter and a semi-cylindrical portion integral with said cylindrical portion, said ball charging means being mounted such that the outer surface of said semi-cylindrical portion is inclined at an angle of between 30° and 60° to the supporting plate.

* * * * *